US010159298B2

(12) United States Patent
Spanks et al.

(10) Patent No.: US 10,159,298 B2
(45) Date of Patent: Dec. 25, 2018

(54) ARTICLE OF FOOTWEAR INCORPORATING AN ILLUMINABLE PANEL

(71) Applicant: NIKE, Inc., Beaverton, OR (US)

(72) Inventors: Jeffrey C. Spanks, Portland, OR (US); Tiffany A. Beers, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 136 days.

(21) Appl. No.: 15/145,039

(22) Filed: May 3, 2016

(65) Prior Publication Data

US 2016/0242491 A1 Aug. 25, 2016

Related U.S. Application Data

(62) Division of application No. 14/027,617, filed on Sep. 16, 2013, now Pat. No. 9,351,538, which is a division
(Continued)

(51) Int. Cl.

| | |
|---|---|
| ***A43B 23/00*** | (2006.01) |
| ***A43C 13/00*** | (2006.01) |
| ***A43B 3/00*** | (2006.01) |
| ***A43B 1/00*** | (2006.01) |
| ***A43B 23/02*** | (2006.01) |
| ***A43B 23/24*** | (2006.01) |

(52) U.S. Cl.
CPC ..... *A43B 3/001* (2013.01); *A43B 1/0036* (2013.01); *A43B 1/0072* (2013.01); *A43B 23/0235* (2013.01); *A43B 23/24* (2013.01)

(58) Field of Classification Search
CPC ..... A43B 1/00; A43B 13/12; A43B 23/02; A43B 1/0036; A43C 1/00
USPC ..... 36/50.1, 45, 84, 103, 137
See application file for complete search history.

(56) References Cited

U.S. PATENT DOCUMENTS

| | | | |
|---|---|---|---|
| 1,184,396 | A | 5/1916 | John |
| 1,949,318 | A | 2/1934 | Markowsky |

(Continued)

FOREIGN PATENT DOCUMENTS

| | | | |
|---|---|---|---|
| EP | 0121026 | A1 | 10/1984 |
| EP | 0534560 | A1 | 3/1993 |

(Continued)

OTHER PUBLICATIONS

Amendment dated Apr. 2, 2014 for U.S. Appl. No. 13/905,917, filed May 30, 2013.

(Continued)

*Primary Examiner* — Timothy K Trieu
(74) *Attorney, Agent, or Firm* — Banner & Witcoff, Ltd.

(57) ABSTRACT

An article of footwear may have an upper and a sole structure secured to the upper. The upper includes an illuminable panel and a plurality of strands positioned to extend adjacent and parallel to the illuminable panel. The illuminable panel has a surface with a covered area and an exposed area. The covered area includes a substantially opaque covering, and the exposed area is at least partially visible from the exterior of the footwear. The strands are located to correspond with the exposed area of the illuminable panel. Light from the exposed area of the illuminable panel may enhance, highlight, or otherwise increase the visibility of the strands or areas of the upper that include the strands.

16 Claims, 12 Drawing Sheets

Related U.S. Application Data of application No. 12/704,126, filed on Feb. 11, 2010, now Pat. No. 8,544,197.

(56) References Cited

U.S. PATENT DOCUMENTS 2,205,356 A 6/1940 Gruensfelder et al.
2,372,903 A 4/1945 Lynch
2,545,809 A 3/1951 Faulk
D174,987 S 6/1955 Gillis et al.
3,008,038 A 11/1961 Dickens et al.
3,070,907 A 1/1963 Rocco
3,484,881 A 12/1969 Marvin
3,505,131 A 4/1970 John
3,595,657 A 7/1971 Ian et al.
3,893,247 A 7/1975 Dana, III
3,946,505 A 3/1976 Dana, III
4,130,951 A 12/1978 Powell
4,234,907 A 11/1980 Daniel
4,253,253 A 3/1981 McCormick
D283,364 S 4/1986 Gamm
4,651,447 A 3/1987 Sullivan
4,748,366 A 5/1988 Taylor
4,756,098 A * 7/1988 Boggia ..... A43B 5/00 36/114
4,848,009 A 7/1989 Rodgers
4,858,339 A 8/1989 Hayafuchi et al.
4,999,936 A 3/1991 Calamia et al.
5,033,212 A 7/1991 Evanyk
5,052,131 A 10/1991 Rondini
5,165,190 A 11/1992 Smyth
5,188,447 A 2/1993 Chiang et al.
5,209,000 A 5/1993 Rowland et al.
5,303,131 A 4/1994 Wu
5,303,485 A 4/1994 Goldston et al.
5,329,432 A 7/1994 Bland
5,359,790 A 11/1994 Iverson et al.
5,381,615 A 1/1995 MacMillan
5,396,720 A 3/1995 Hwang et al.
5,406,724 A 4/1995 Lin
5,408,764 A 4/1995 Wut
5,421,106 A 6/1995 Emrick
5,438,488 A 8/1995 Dion
5,457,900 A 10/1995 Roy
5,461,188 A 10/1995 Drago et al.
5,483,759 A 1/1996 Silverman
5,490,338 A 2/1996 Hwang et al.
5,495,136 A 2/1996 Chiang et al.
5,546,681 A 8/1996 Goldston et al.
5,572,817 A 11/1996 Chien
5,599,088 A 2/1997 Chien
5,611,621 A 3/1997 Chien
5,649,755 A 7/1997 Rapisarda
5,704,705 A 1/1998 Chien
5,732,486 A 3/1998 Rapisarda
5,737,854 A 4/1998 Sussmann
5,746,499 A 5/1998 Ratcliffe et al.
5,765,300 A 6/1998 Kianka
5,771,611 A 6/1998 Chang
5,794,366 A 8/1998 Chien
5,806,960 A 9/1998 Chien
5,812,063 A 9/1998 Weng et al.
5,813,148 A * 9/1998 Guerra ..... A43B 1/0036 36/137
5,857,273 A 1/1999 Rapisarda
5,860,727 A 1/1999 Chien
5,865,523 A 2/1999 Chien
5,866,987 A 2/1999 Wut
5,869,930 A 2/1999 Baumberg et al.
5,879,069 A 3/1999 Chien
5,894,201 A 4/1999 Wong
5,894,686 A 4/1999 Parker et al.
5,909,088 A 6/1999 Wut
5,930,921 A 8/1999 Sorofman et al.
5,945,911 A 8/1999 Healy et al.
5,947,580 A 9/1999 Chien
5,955,957 A 9/1999 Calabrese et al.
5,969,479 A 10/1999 Wong
6,012,822 A 1/2000 Robinson
6,017,128 A 1/2000 Goldston et al.
6,030,089 A 2/2000 Parker et al.
6,052,921 A 4/2000 Oreck
6,104,140 A 8/2000 Wut et al.
6,112,437 A 9/2000 Lovitt
6,164,794 A 12/2000 Rodgers
6,280,045 B1 8/2001 Anteby et al.
6,457,261 B1 10/2002 Crary
6,619,812 B2 9/2003 Rapisarda
6,669,151 B2 12/2003 Mascadri
6,754,983 B2 * 6/2004 Hatfield ..... A43B 3/163 36/101
6,764,193 B1 7/2004 Wei
6,789,913 B2 9/2004 Wei
6,837,590 B2 1/2005 Marston
6,843,578 B1 1/2005 Cheung
6,862,820 B2 3/2005 Farys et al.
6,910,288 B2 6/2005 Dua
6,991,342 B2 1/2006 Gonet
7,054,784 B2 5/2006 Flentov et al.
7,114,822 B2 10/2006 Guzman
7,147,337 B1 12/2006 Rapisarda
7,171,331 B2 1/2007 Vock et al.
7,178,929 B2 2/2007 Guzman
7,181,870 B2 2/2007 Guzman
D551,438 S 9/2007 Laberge
7,270,616 B1 9/2007 Snyder
7,329,019 B2 2/2008 Cheung
D580,155 S 11/2008 Banik
7,494,237 B1 2/2009 Cheung
D595,499 S 7/2009 Dekovic
7,774,956 B2 8/2010 Dua et al.
7,870,682 B2 1/2011 Meschter et al.
7,996,924 B2 * 8/2011 Wright ..... A41D 13/0015 2/239
8,001,705 B2 8/2011 Cagliari
8,034,273 B2 10/2011 Lalande et al.
8,122,616 B2 2/2012 Meschter et al.
8,132,340 B2 3/2012 Meschter
8,266,827 B2 9/2012 Dojan et al.
8,453,357 B2 6/2013 Beers et al.
8,544,197 B2 10/2013 Spanks et al.
2001/0024364 A1 9/2001 Hurwitz
2003/0070324 A1 4/2003 Nelson
2004/0103563 A1 6/2004 Linge
2004/0181972 A1 9/2004 Csorba
2004/0255490 A1 12/2004 Wan et al.
2005/0018417 A1 1/2005 Chien
2005/0018450 A1 1/2005 Chien
2005/0183294 A1 8/2005 Guzman
2005/0193592 A1 9/2005 Dua et al.
2005/0207138 A1 9/2005 Cheung
2005/0268497 A1 12/2005 Alfaro et al.
2005/0284000 A1 12/2005 Kerns
2005/0286244 A1 12/2005 Weng
2005/0286248 A1 12/2005 Weng
2006/0007668 A1 1/2006 Chien
2006/0007670 A1 1/2006 Chien
2006/0101674 A1 5/2006 Ungari
2006/0104046 A1 5/2006 Guzman
2006/0130373 A1 6/2006 Snyder
2006/0198121 A1 9/2006 Thorpe et al.
2006/0221596 A1 10/2006 Chang
2006/0229149 A1 10/2006 Goedoen
2006/0262517 A1 11/2006 Doerer et al.
2007/0028486 A1 2/2007 Montanya et al.
2007/0041193 A1 2/2007 Wong et al.
2007/0147026 A1 6/2007 Tseng et al.
2007/0201221 A1 8/2007 Cherdak et al.
2007/0211451 A1 9/2007 Chung
2007/0236915 A1 10/2007 Chen
2008/0110049 A1 5/2008 Sokolowski et al.
2008/0163976 A1 7/2008 Lalande et al.
2009/0007459 A1 1/2009 Barnett
2009/0158622 A1 6/2009 Cook et al.
2010/0154256 A1 6/2010 Dua

(56) References Cited

U.S. PATENT DOCUMENTS

| | | | |
|---|---|---|---|
| 2010/0251491 | A1 | 10/2010 | Dojan et al. |
| 2010/0263236 | A1 | 10/2010 | Carboy et al. |
| 2011/0061154 | A1 | 3/2011 | Turner et al. |
| 2011/0094127 | A1 | 4/2011 | Dana, III |
| 2011/0192053 | A1 | 8/2011 | Beers |
| 2011/0192058 | A1 | 8/2011 | Beers et al. |
| 2011/0192059 | A1 | 8/2011 | Spanks et al. |
| 2012/0007504 | A1 | 1/2012 | Beers et al. |
| 2013/0333250 | A1 | 12/2013 | Beers et al. |
| 2014/0068974 | A1 | 3/2014 | Spanks et al. |
| 2014/0075785 | A1 | 3/2014 | Spanks et al. |

FOREIGN PATENT DOCUMENTS

| | | | |
|---|---|---|---|
| FR | 2643794 | A1 | 9/1990 |
| JP | H10225305 | A | 8/1998 |
| WO | 9415494 | A1 | 7/1994 |

OTHER PUBLICATIONS

Amendment dated Jan. 9, 2013 for U.S. Appl. No. 12/704,110, filed Nov. 2, 2010.

Amendment dated Jan. 14, 2013 for U.S. Appl. No. 12/704,126, filed Nov. 2, 2010.

Final Office Action dated Jan. 2, 2014 for U.S. Appl. No. 13/905,917, filed May 30, 2013.

Notice of Allowance dated Jun. 3, 2013 for U.S. Appl. No. 12/704,126, filed Nov. 2, 2010.

Notice of Allowance dated Feb. 8, 2013 for U.S. Appl. No. 12/704,110.

Notice of Allowance dated Feb. 8, 2016 for U.S. Appl. No. 14/027,617, filed Sep. 16, 2013.

Notice of Allowance dated Feb. 16, 2016 for U.S. Appl. No. 14/027,585, filed Sep. 16, 2013.

Notice of Allowance dated Apr. 24, 2014 for U.S. Appl. No. 13/905,917, filed May 30, 2013.

Office Action dated Oct. 9, 2012 for U.S. Appl. No. 12/704,110.

Office Action dated Oct. 12, 2012 for U.S. Appl. No. 12/704,126.

Response to Office Action dated Oct. 12, 2012 for U.S. Appl. No. 12/704,126, filed Jan. 14, 2013.

Response to Restriction Requirement dated Nov. 10, 2015 for U.S. Appl. No. 14/027,617, filed Sep. 16, 2013.

Response to Restriction Requirement dated Nov. 18, 2015 for U.S. Appl. No. 14/027,585, filed Sep. 16, 2013.

Restriction Requirement dated Sep. 10, 2015 for U.S. Appl. No. 14/027,617, filed Sep. 16, 2013.

Restriction Requirement dated Sep. 25, 2015 in U.S. Appl. No. 14/027,585, filed Sep. 16, 2013.

* cited by examiner

ARTICLE OF FOOTWEAR INCORPORATING AN ILLUMINABLE PANEL

CROSS-REFERENCE TO RELATED APPLICATION

This application is a divisional of Spanks et al., U.S. Patent Application Publication No. 2014/0068974, published on Mar. 13, 2014, entitled "Article of Footwear Incorporating an Illuminable Panel," which is a divisional of Spanks et al., U.S. Patent Application Publication No. 2011/0192059, published on Aug. 11, 2011, entitled "Article of Footwear Incorporating an Illuminable Panel." The entire disclosures of these publications are incorporated herein by reference.

BACKGROUND

Articles of footwear generally include two primary elements, an upper and a sole structure. The upper may be formed from a variety of material elements (e.g., textiles, polymer sheets, foam layers, leather, synthetic leather) that are stitched or adhesively bonded together to form a void for comfortably and securely receiving a foot. More particularly, the upper generally extends over the instep and toe areas of the foot, along the medial and lateral sides of the foot, under the foot, and around the heel area of the foot. In some articles of footwear, such as basketball shoes and boots, the upper may extend upward and around the ankle to provide support or protection for the ankle. Access to the void within the upper is generally provided by an ankle opening in a heel region of the footwear. A lacing system is often incorporated into the upper to adjust the fit of the upper, as well as permitting entry and removal of the foot from the void within the upper. In addition, the upper may include a tongue that extends under the lacing system to enhance adjustability and comfort of the footwear.

The sole structure is secured to a lower portion of the upper and is generally positioned between the foot and the ground. In many articles of footwear, including athletic footwear, the sole structure incorporates a sockliner, a midsole, and an outsole. The sockliner is a thin, compressible member located within the void (i.e., under the foot) to enhance footwear comfort. The midsole extends downward from the upper and forms a middle layer of the sole structure. In addition to attenuating ground reaction forces (i.e., providing cushioning for the foot), the midsole may limit foot motions or impart stability, for example. Although the midsole of athletic footwear may be primarily formed from a foamed polymer material, the midsole may include a variety of additional footwear elements that enhance the comfort or performance of the footwear, including plates, moderators, fluid-filled chambers, lasting elements, or motion control members. The outsole is secured to a lower surface of the midsole and forms a ground-contacting portion of the footwear. Additionally, the outsole may be formed from a durable and wear-resistant material that includes texturing to improve traction.

SUMMARY

An article of footwear is disclosed herein as having an upper and a sole structure secured to the upper. The upper includes an illuminable panel and a plurality of strands positioned to extend adjacent and parallel to the illuminable panel. The illuminable panel has a surface with a covered area and an exposed area. The covered area includes a substantially opaque covering, and the exposed area is at least partially visible from the exterior of the footwear. The strands are located to correspond with the exposed area of the illuminable panel.

An article of footwear may also incorporate an upper with an illuminable panel, a cover layer, and a plurality of strands. The illuminable panel has a surface with a covered area and an exposed area including a plurality of linear portions extending between a lace region of the upper and a region where the sole structure is joined to the upper. The cover layer extends adjacent to the surface of the illuminable panel and forms at least a portion of an exterior surface of the upper. The cover layer may also be formed from an at least semi-transparent material. The strands are positioned between the cover layer and the exposed area of the illuminable panel.

Additionally, an article of footwear may have an upper with (a) a lace region having a plurality of lace-receiving elements and (b) a lower region where a sole structure is secured to the upper. An illuminable panel is at least partially located between the lace region and the lower region, and the illuminable panel defines a plurality of substantially linear areas extending between the lace region and the lower region. A plurality of strands are positioned adjacent to the illuminable panel and extend along the linear areas of the illuminable panel.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

DETAILED DESCRIPTION

Figure 1:
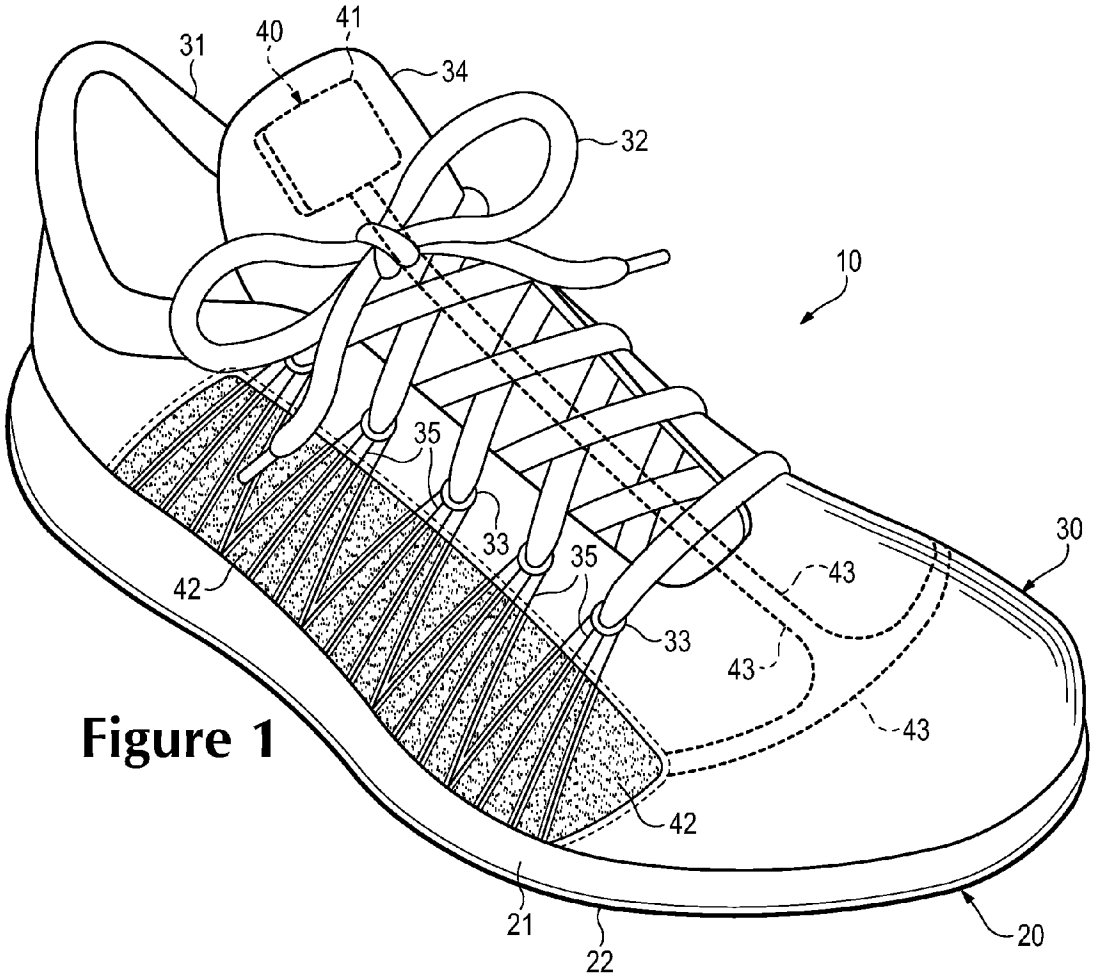
FIG. 1 is a perspective view of an article of footwear.

The following discussion and accompanying figures disclose various configurations of an article of footwear 10 that incorporates illuminable elements. Concepts related to the illuminable elements are disclosed with reference to footwear that is suitable for running. The illuminable elements are not limited to footwear designed for running, however, and may be utilized with a wide range of athletic footwear styles, including basketball shoes, cross-training shoes, cycling shoes, football shoes, soccer shoes, tennis shoes, and walking shoes, for example. The illuminable elements may also be utilized with footwear styles that are generally considered to be non-athletic, including dress shoes, loafers, sandals, and boots. The concepts disclosed herein may, therefore, apply to a wide variety of footwear styles, in addition to the specific style discussed in the following material and depicted in the accompanying figures.

General Footwear Configuration

Footwear 10 is depicted in FIGS. 1-5B as including a sole structure 20, an upper 30, and an illumination circuit 40. In general, illumination circuit 40 is utilized to illuminate portions of footwear 10 (e.g., sides of upper 30). In addition to imparting a unique aesthetic to footwear 10 and enhancing enjoyment of the wearer of footwear 10, illuminating portions of footwear 10 may increase the visibility of (a) the wearer, thereby making the wearer more visible to others in low light or darkened conditions and (b) obstacles or aspects of the ground (e.g., road, trail, running path), thereby making the obstacles more visible to the wearer. Illuminating portions of footwear 10 may also be utilized during product testing to enhance the visibility of areas of footwear 10 that are subjected to tensile, compression, bending, or twisting forces. That is, illuminating areas of footwear 10 may improve the degree to which the areas of footwear 10 are visible on high-speed film or other mediums that visually-capture performance data during biomechanical or other forms of testing.

Figure 3:
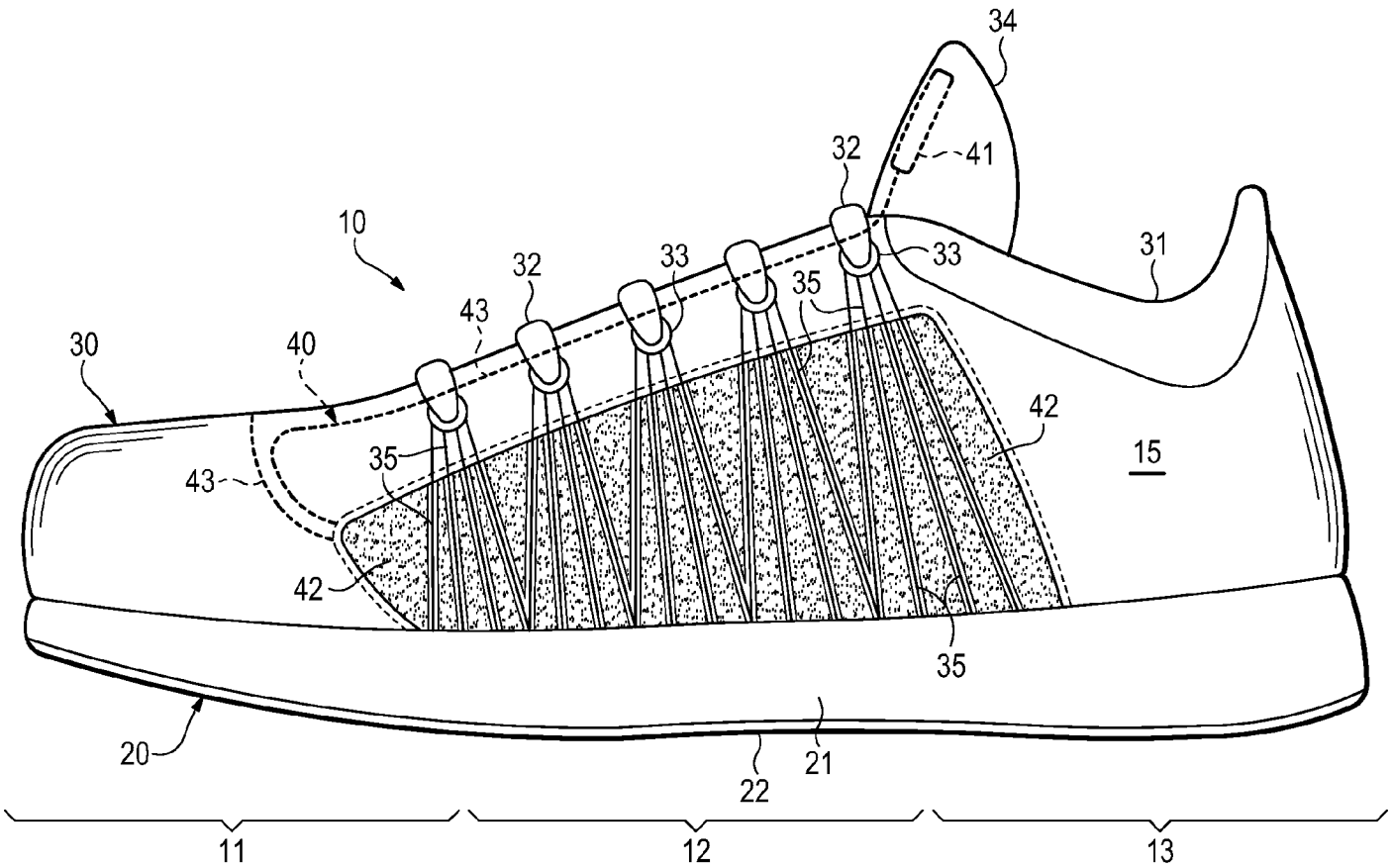
FIG. 3 is a medial side elevational view of the article of footwear.
Figure 4:
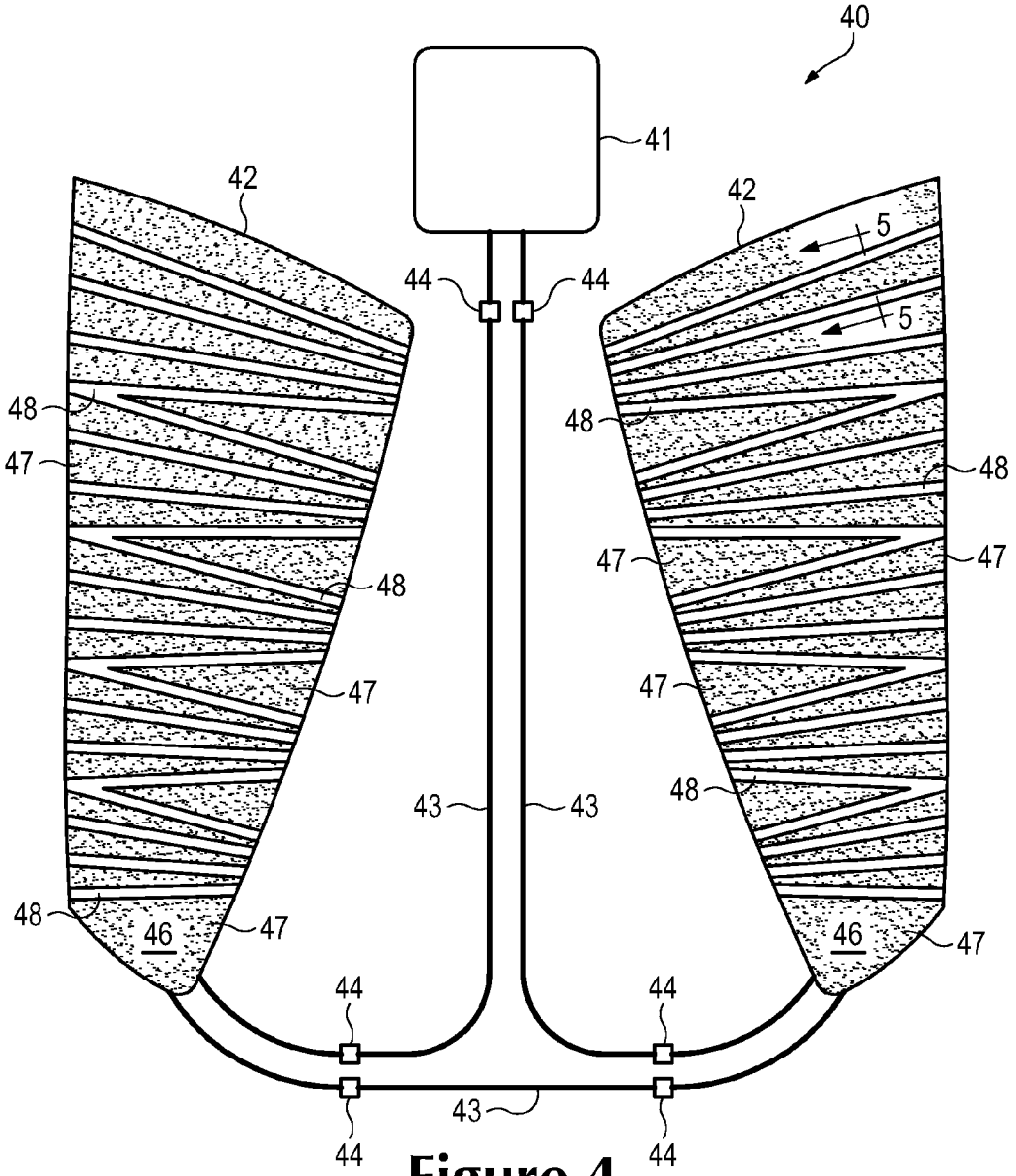
FIG. 4 is a schematic diagram of an illumination circuit of the article of footwear.

For reference purposes, footwear 10 may be divided into three general regions: a forefoot region 11, a midfoot region 12, and a heel region 13, as shown in FIGS. 3 and 4. Footwear 10 also includes a lateral side 14 and a medial side 15. Forefoot region 11 generally includes portions of footwear 10 corresponding with the toes and the joints connecting the metatarsals with the phalanges. Midfoot region 12 generally includes portions of footwear 10 corresponding with an arch area of the foot. Heel region 13 generally corresponds with rear portions of the foot, including the calcaneus bone. Lateral side 14 and medial side 15 extend through each of regions 11-13 and correspond with opposite sides of footwear 10. Regions 11-13 and sides 14-15 are not intended to demarcate precise areas of footwear 10. Rather, regions 11-13 and sides 14-15 are intended to represent general areas of footwear 10 to aid in the following discussion. In addition to footwear 10, regions 11-13 and sides 14-15 may also be applied to sole structure 20, upper 30, illumination circuit 40, and individual elements thereof.

Sole structure 20 is secured to upper 30 and extends between the foot and the ground when footwear 10 is worn. The primary elements of sole structure 20 are a midsole 21 and an outsole 22. Midsole 21 is secured to a lower surface of upper 30 and may be formed from a compressible polymer foam element (e.g., a polyurethane or ethylvinylacetate foam) that attenuates ground reaction forces (i.e., provides cushioning) when compressed between the foot and the ground during walking, running, or other ambulatory activities. In further configurations, midsole 21 may incorporate plates, moderators, fluid-filled chambers, lasting elements, or motion control members that further attenuate forces, enhance stability, or influence the motions of the foot, or midsole 21 may be primarily formed from a fluid-filled chamber. Outsole 22 is secured to a lower surface of midsole 21 and may be formed from a wear-resistant rubber material that is textured to impart traction. A sockliner may also be located within upper 30 and positioned to extend under a lower surface of the foot. Although this configuration for sole structure 20 provides an example of a sole structure that may be used in connection with upper 30, a variety of other conventional or nonconventional configurations for sole structure 20 may also be utilized. Accordingly, the structure and features of sole structure 20 or any sole structure utilized with upper 30 may vary considerably.

Upper 30 defines a void within footwear 10 for receiving and securing a foot relative to sole structure 20. The void is shaped to accommodate the foot and extends along the lateral side of the foot, along the medial side of the foot, over the foot, around the heel, and under the foot. Access to the void is provided by an ankle opening 31 located in at least heel region 13. A lace 32 extends through various lace apertures 33 or other lace-receiving elements (e.g., D-rings, hooks) and permits the wearer to modify dimensions of upper 30 to accommodate the proportions of the foot. More particularly, lace 32 permits the wearer to tighten upper 30 around the foot, and lace 32 permits the wearer to loosen upper 30 to facilitate entry and removal of the foot from the void (i.e., through ankle opening 31). In addition, upper 30 includes a tongue 34 that extends between the interior void and lace 32

The various portions of upper 30 may be formed from one or more of a plurality of material elements (e.g., textiles, polymer sheets, foam layers, leather, synthetic leather) that are stitched or bonded together to form the void within footwear 10. Upper 30 may also incorporate a heel counter that limits heel movement in heel region 13 or a wear-resistant toe guard located in forefoot region 11. Although a variety of material elements or other elements may be incorporated into upper, areas of lateral side 14 and medial side 15 incorporate various strands 35 that extend adjacent to a portion of illumination circuit 40 and are illuminated by illumination circuit 40. That is, illumination circuit is utilized to enhance, highlight, or otherwise increase the visibility of strands 35 or areas of upper 30 that include strands 35.

During walking, running, or other ambulatory activities, a foot within the void in footwear 10 may tend to stretch upper 30. That is, many of the material elements forming upper 30 may stretch when placed in tension by movements of the foot. Although strands 35 may also stretch, strands 35 generally stretch to a lesser degree than the other material elements forming upper 30. Each of strands 35 may be located, therefore, to form structural components in upper 30 that resist stretching in specific directions or reinforce locations where forces are concentrated. With regard to the configuration depicted in FIGS. 1-3, strands 35 extend between lace apertures 33 and sole structure 20 to resist stretch in the medial-lateral direction (i.e., in a direction extending around upper 30). Strands 35 are also positioned adjacent to and radiate outward from lace apertures 33 to resist stretch due to tension in lace 32. Accordingly, strands 34 are located to form structural components in upper 30 that resist stretch.

Illumination Circuit

Illumination circuit 40 is depicted in FIG. 4 and includes a power source 41, a pair of illuminable elements 42, lead wires 43, and various connectors 44. In general, power source 41 delivers current and voltage to illuminable elements 42 through the various lead wires 43 and connectors 44, thereby inducing illuminable elements 42 to illuminate or otherwise emit light. Illuminable elements 42 are incorporated into sides 14 and 15 of upper 30 adjacent to the various strands 35 and have the configurations of electroluminescent panels (i.e., EL panels, light emitting capacitors). When illuminated, light emitted from illuminable elements 42 enhances, highlights, or otherwise increases the visibility of strands 35 or areas of upper 30 that include strands 35.

Illuminable elements 42 have the configuration of electroluminescent panels, but may also be one or more light emitting diodes or electroluminescent wires. An electroluminescent panel has a series of layers that include insulator layers, conductor layers, and a phosphor layer. In operation, power source 41 delivers alternating current to illuminable elements 42 through the various lead wires 43 and connectors 44. The alternating current passes through the conductor layers, which produces an alternating electric field that induces the phosphor layer to glow or otherwise emit light. Although the frequency of the alternating electric field has an effect upon the wavelength of the light emitted from the phosphor layer, coloring in the insulator layers may impart specific colors to the light that is emitted from illuminable element 42.

Power source 41 is depicted as being incorporated into upper 30, particularly tongue 34. In general, power source 41 may be any oscillating electric potential source, including an alternating current source, a direct current to alternating current converter output (i.e., the output of a battery and an inverter), or an electric oscillator (i.e., a sine wave generator, a square wave generator, or a tuned LC oscillator), for example. As a more specific example, power source 41 may include (a) a rechargeable polymer lithium-ion battery having an output of 3.7 volts and 300 milliampere hours and (b) an inverter providing an output of 264-330 volts peak-to-peak at a frequency of 425-525 hertz. Depending upon various factors, however, the battery and inverter specification may vary significantly. For example, the desired (a) area of the electroluminescent panels forming illuminable elements 42, (b) intensity of the light output of illuminable elements 42, and (c) time during which illuminable elements 42 are to remain illuminated may all affect specifications for the battery and inverter utilized in power source 41. Although power source 41 is depicted as being a single component that includes the battery and inverter, power source 41 may also be a separate battery and inverter within illumination circuit 40. Additionally, power source 41 may include (a) a switch that permits the wearer to selectively emit light or vary the intensity of the light output and (b) a connector for recharging the battery. Accordingly, power source 41 may have a variety of configurations that are sufficient to illuminate illuminable elements 42.

Lead wires 43 have the configuration of any electrically-conductive material, such as insulated copper wire, and are electrically-coupled to power source 41 with a pair of connectors 44. Given that power source 41 is located in an upper area of tongue 34, lead wires 43 extend along the length of tongue 34, pass through sides 14 and 15 of upper 30, and are electrically-coupled to illuminable elements 42 with another pair of connectors 44. A further lead wire 43 is electrically-coupled to illuminable elements 42 with another pair of connectors 44 to complete the circuit. Although this general configuration provides an efficient manner of joining the various elements of illumination circuit 40, other layouts or methods of distributing the elements of illumination circuit 40 may also be utilized. Moreover, connectors 44 may have a variety of configurations that are suitable for joining electrical components, and lead wires 43 may be formed to join with power source 41 and illuminable element 42 without connectors (e.g., with soldered connections) in some configurations of footwear 10.

Figure 5:
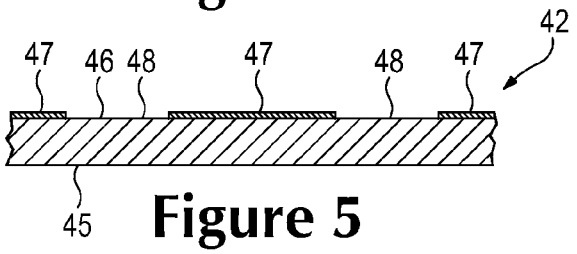
FIG. 5 is a cross-sectional view of an illuminable element of the illumination circuit, as defined by section line 7 in FIG. 6.

Illuminable elements 42 each include an inward-facing surface 45 and an opposite outward-facing surface 46. Whereas inward-facing surfaces 45 face toward an interior of footwear 10 (i.e., toward the void within upper 30), outward-facing surfaces 46 face toward an exterior of footwear 10. Referring to FIGS. 4 and 5, for example, outward-facing surfaces 46 each include covered areas 47 and exposed areas 48. For purposes of reference, covered areas 47 are depicted as having a stippled configuration, whereas stippling is absent in exposed areas 48. Covered areas 47 include a substantially opaque covering, whereas the covering is absent in exposed areas 48. When illuminated elements 42 are illuminated, covered areas 47 block or substantially prevent light from being visible from the exterior of footwear 10, whereas light from exposed areas 48 is visible from the exterior of footwear 10. Strands 35 are positioned to extend adjacent and parallel to the illuminable elements 42, and strands 35 are located to correspond with exposed areas 48. That is, strands 35 may extend along exposed areas 48. Given that strands 35 generally follow a straight or linear path along illuminable elements 42, exposed areas 48 may also have a substantially linear configuration. Since light from exposed areas 48 is visible from the exterior of footwear 10, this configuration enhances, highlights, or otherwise increases the visibility of the various strands 35 or areas of upper 30 that include strands 35.

The covering utilized in covered areas 47 may be opaque or may merely reduce the intensity of light that is visible from the exterior of footwear 10. A variety of polymer sheets or materials, paints, decals, or textiles may be utilized to form the covering of covered areas 47. In some configurations, covered areas 47 may be formed by screen-printing the covering on specific areas of outward-facing surface 46. That is, a screen-printing process may be utilized to accurately form covered areas 47 and define exposed areas 48. Other printing processes may also be utilized to deposit material onto outward-facing surface 46 and form covered areas 47. In some configurations of footwear 10, etching or other removal processes (e.g., chemical etching, laser cutting) may be utilized to remove the phosphor layer of electroluminescent panels forming illuminable elements 42, thereby preventing those areas from illuminating upon the application of alternating current from power source 41. Moreover, excess areas of illuminable elements 42 that are either beyond the periphery of covered areas 47 or within covered areas 47 may be cut away or otherwise removed (e.g., with a laser or other cutting apparatus), which may reduce the area of illuminable elements 42 that illuminate and save energy within illumination circuit 40. Additionally, polymer sheets with alternating opaque and translucent areas corresponding with the locations of areas 47 and 48 may also cover or extend over illuminable elements 42. Accordingly, a variety of methods or structures may be utilized to prevent light from being visible from specific areas of illuminable elements 42.

Upper Configuration

Figure 6:
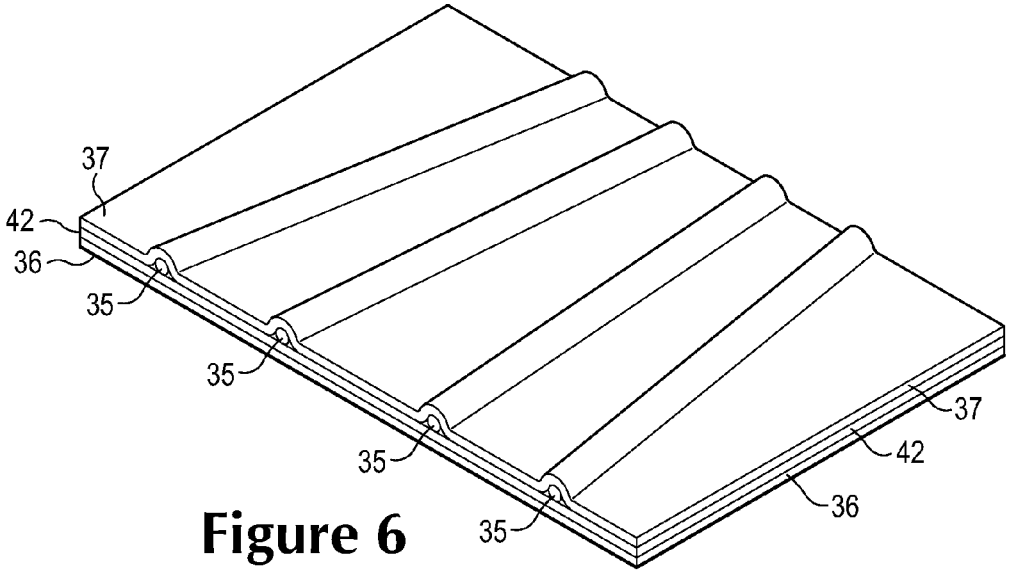
FIG. 6 is a perspective view of a portion of an upper of the article of footwear, as defined in FIG. 2.
Figure 7:
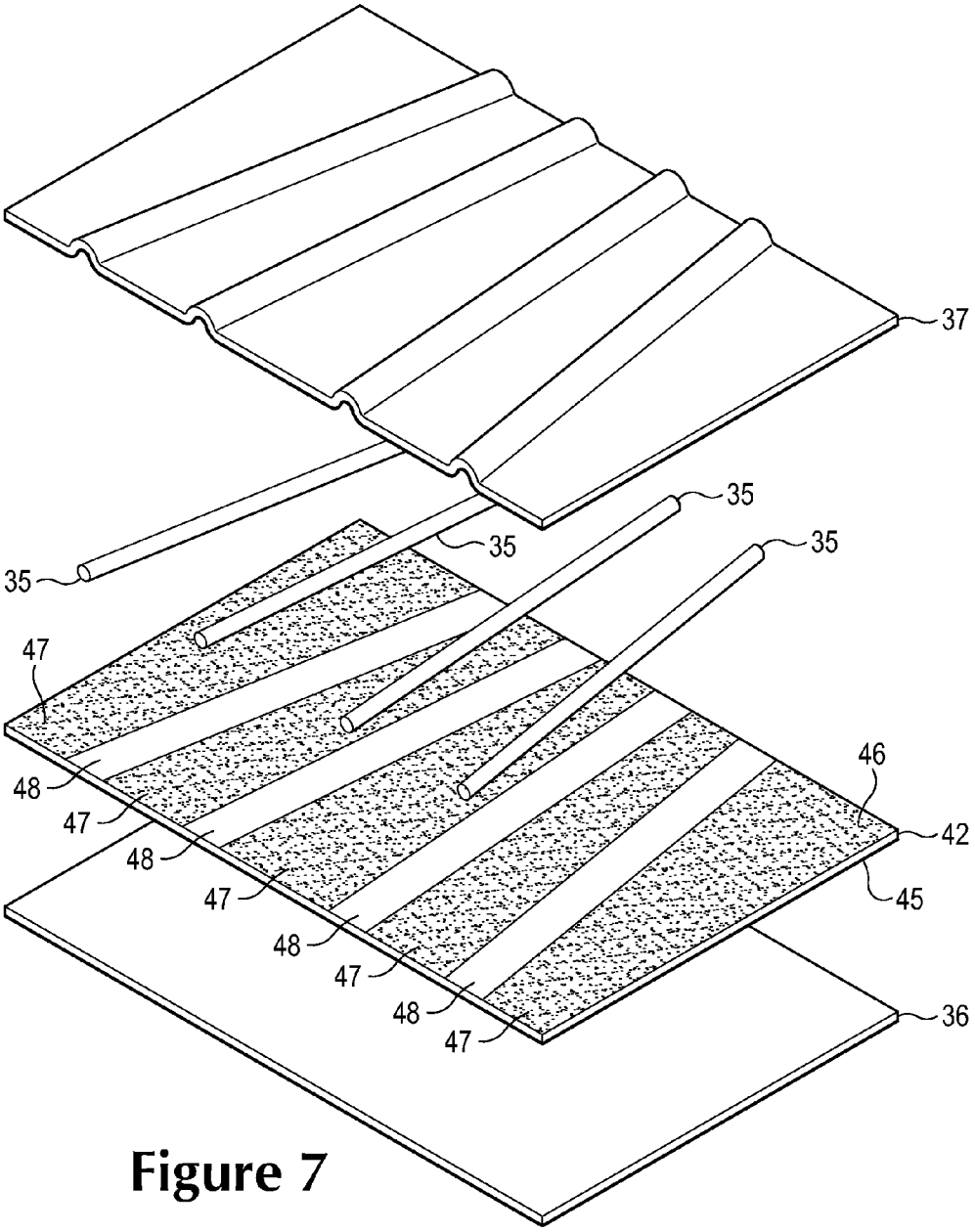
FIG. 7 is an exploded perspective view of the portion of the upper.

A portion of upper 30 is depicted in FIGS. 6 and 7 as including a layered structure having an interior layer 36, one of illuminable elements 42, a few of strands 35, and a section of a cover layer 37. Interior layer 36 may be a textile layer, foam layer, polymer sheet, or other material that generally forms portions of upper 30 located inward of illuminable element 42 and strands 35. In some configurations interior layer 36 may be two or more layers of material (i.e., a textile layer and a foam layer). Illuminable elements 42 are located exterior of interior layer 36, and strands 35 lay adjacent to and contact exposed areas 48 of outward-facing surface 46. Moreover, strands 35 are substantially parallel to outward-facing surface 46 also lay adjacent to cover layer 37. As discussed above, strands 35 form structural components in upper 30 that resist stretch. By being substantially parallel to illuminable elements 42 and cover layer 37, strands 35 resist stretch in directions that correspond with the planes upon which illuminable elements 42 and cover layer 37 lay. Although strands 35 may extend through interior layer 36, illuminable elements 42, or cover layer 37 (e.g., as a result of stitching) in some locations, strands 34 generally extend between illuminable elements 42 and cover layer 37.

Strands 35 may be formed from any generally one-dimensional material. As utilized with respect to the present invention, the term "one-dimensional material" or variants thereof is intended to encompass generally elongate materials exhibiting a length that is substantially greater than a width and a thickness. Accordingly, suitable materials for strands 35 include various filaments, fibers, yarns, threads, cables, or ropes that are formed from rayon, nylon, polyester, polyacrylic, silk, cotton, carbon, glass, aramids (e.g., para-aramid fibers and meta-aramid fibers), ultra high molecular weight polyethylene, liquid crystal polymer, copper, aluminum, and steel. Whereas filaments have an indefinite length and may be utilized individually as strands 35, fibers have a relatively short length and generally go through spinning or twisting processes to produce a strand of suitable length. An individual filament utilized in strands 35 may be formed form a single material (i.e., a monocomponent filament) or from multiple materials (i.e., a bicomponent filament). Similarly, different filaments may be formed from different materials. As an example, yarns utilized as strands 35 may include filaments that are each formed from a common material, may include filaments that are each formed from two or more different materials, or may include filaments that are each formed from two or more different materials. Similar concepts also apply to threads, cables, or ropes.

As discussed above, covered areas 47 include a substantially opaque covering, whereas the covering is absent in exposed areas 48. Referring to FIG. 7, exposed areas 48 have a generally linear configuration and correspond with the positions of strands 35. When illuminated, light from illuminable elements 42 is visible from the areas on either side of strands 35, but light from areas between two strands 35 is generally blocked by covered areas 47. Strands 35 follow a generally linear path and extend between lace apertures 33 and sole structure 20 to resist stretch in the medial-lateral direction (i.e., in a direction extending around upper 30). Given that strands 35 generally follow a straight or linear path along illuminable elements 42, exposed areas 48 may also have a substantially linear configuration.

Cover layer 37 may be formed from any generally transparent or at least partially transparent material that permits strands 35 and light from illuminable elements 42 to be visible from an exterior of footwear 10. As an example, cover layer 37 may be formed from a thermoplastic polyurethane sheet. Although cover layer 37 may be bonded or otherwise secured to illuminable elements 42, cover layer 37 may also be unsecured to illuminable elements 42 (i.e., laying adjacent to illuminable elements 42). Additionally, cover layer 37 may form protrusions on the exterior of upper 30 in areas where strands 35 are located, as depicted in FIG. 6. The protrusions may arise as a result of a molding process for forming upper 30 that may be similar to a molding process disclosed in U.S. patent Ser. No. 12/419,985, which was filed in the U.S. Patent and Trademark Office on 7 Apr. 2009 and entitled Method For Molding Tensile Strand Elements, such application being entirely incorporated herein by reference.

Further Footwear Configurations

Figure 2:
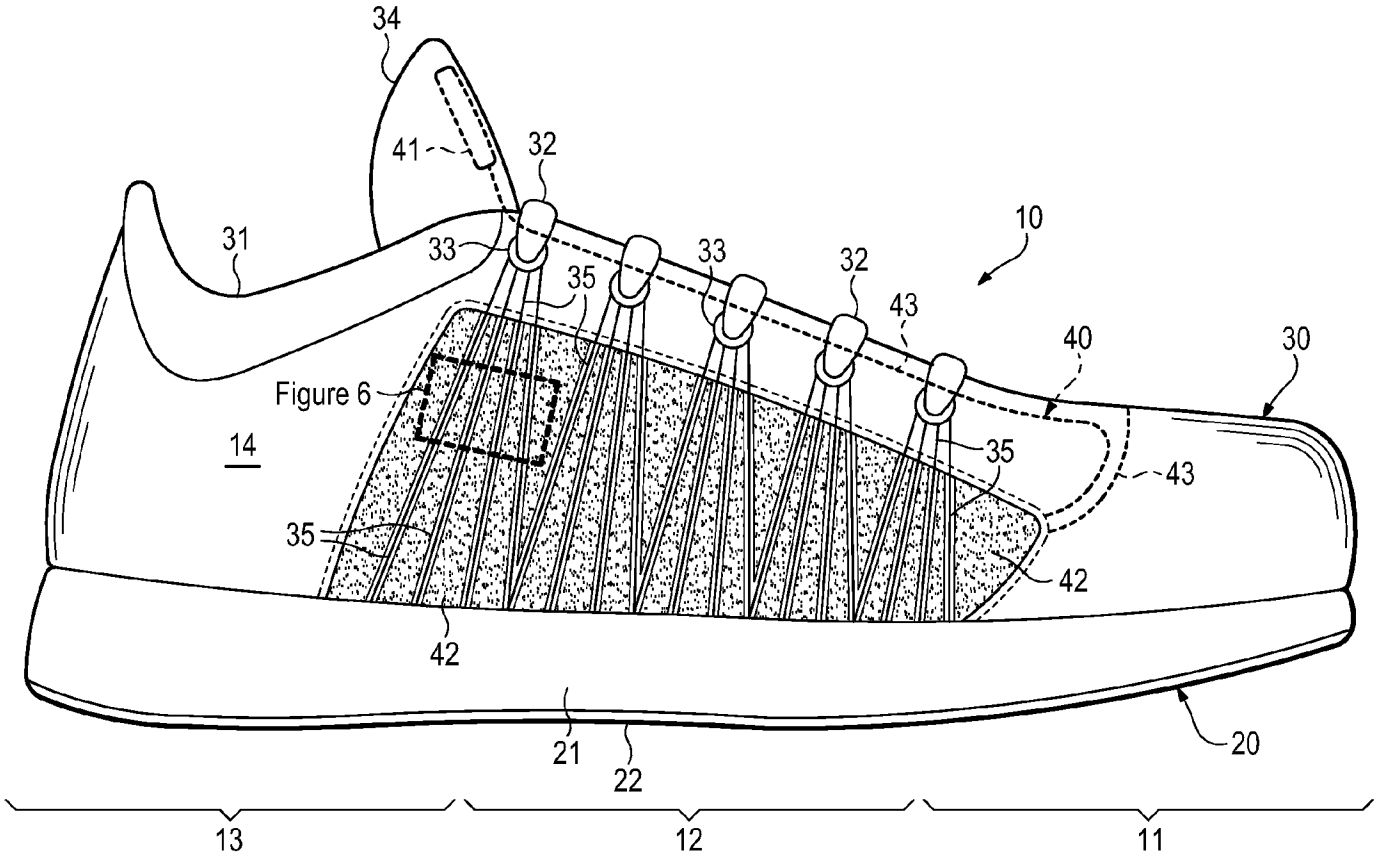
FIG. 2 is a lateral side elevational view of the article of footwear.
Figure 8A:
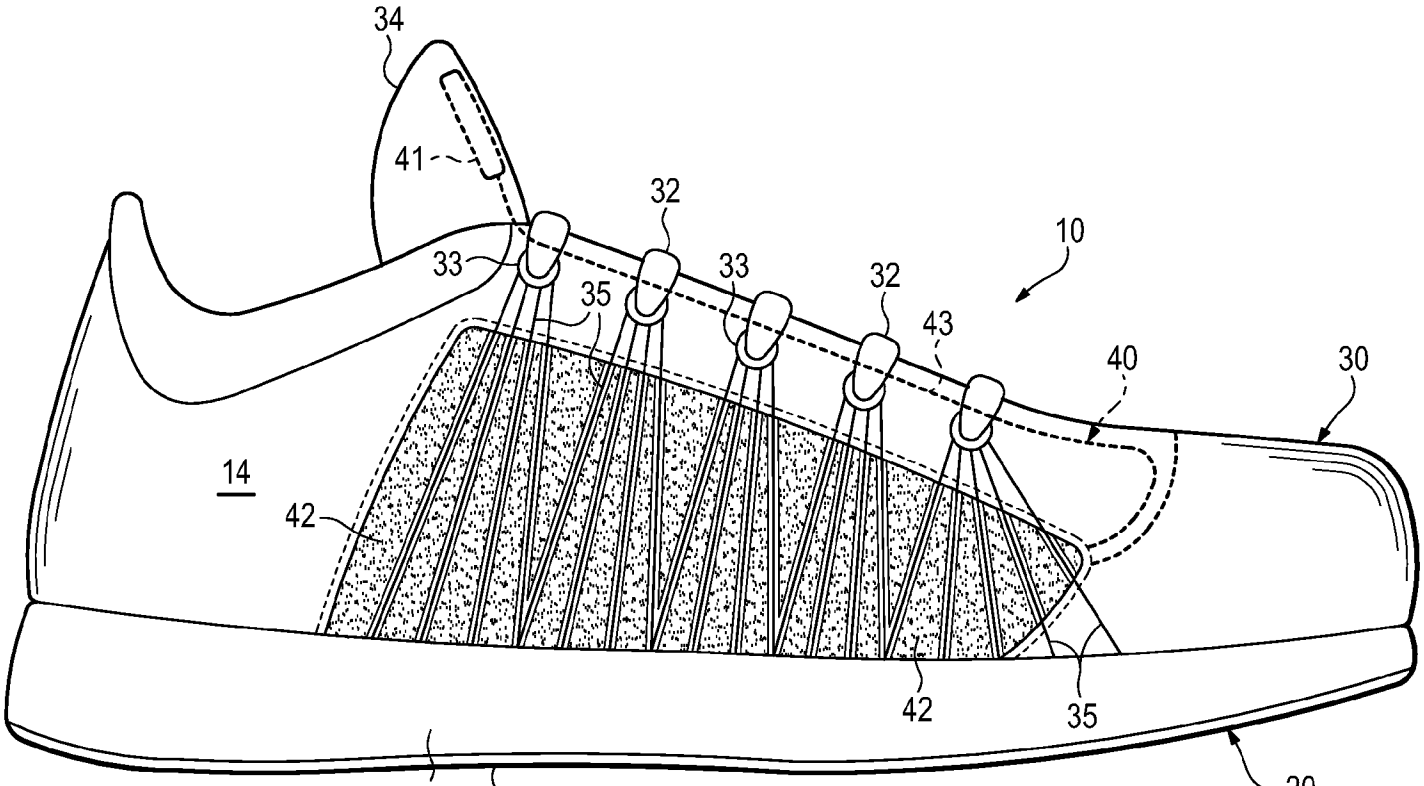
FIGS. 8A-8C are lateral side elevational views corresponding with FIG. 2 and depicting further configurations of the article of footwear.
Figure 8B:
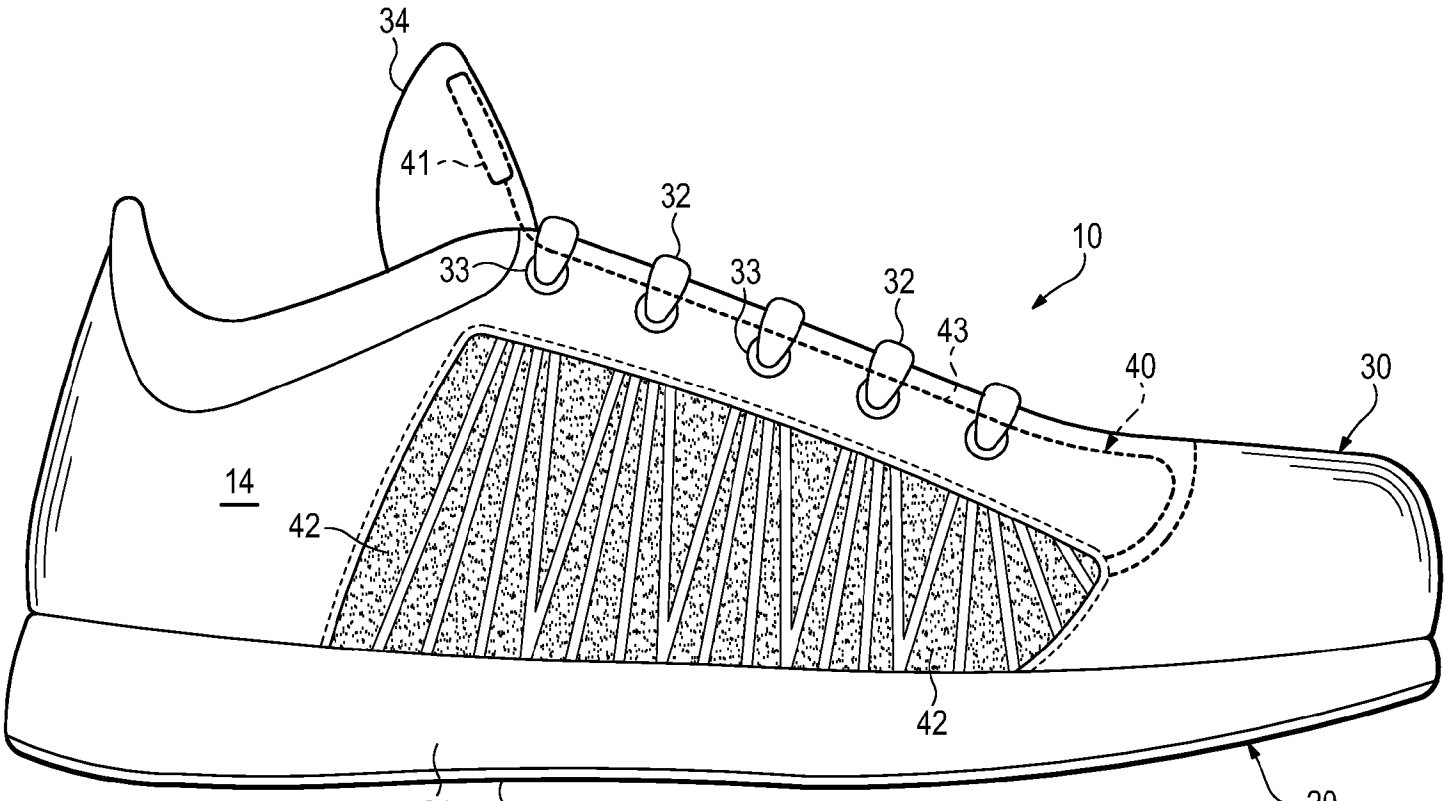
Figure 8C:
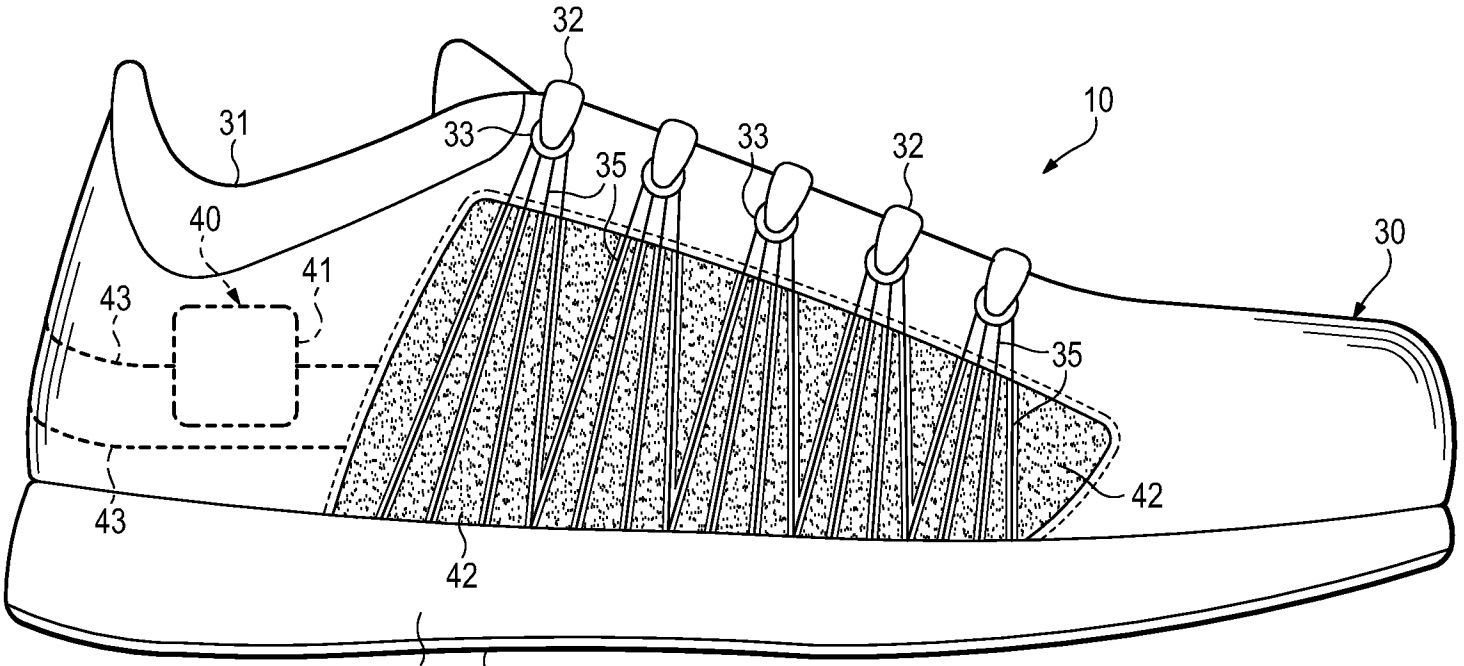

The overall configuration of footwear 10 discussed above is intended to provide an example of a suitable configuration for imparting an illuminable aspect to upper 30. In other configurations of footwear 10, various aspects of sole structure 20, upper 30, and illumination circuit 40 may vary considerably. Although a majority of strands 35 may lay adjacent to illuminable elements 42, some of strands 35 may extend into areas of footwear 10 where illuminable elements 42 are absent, as depicted in forefoot region 11 of FIG. 8A. In some configurations, as depicted in FIG. 8B, strands 35 may be absent from footwear 10, with exposed areas 48 imparting the visual appearance of strands 35. Additionally, the locations of various elements of illumination circuit 40 may vary. For example, power source 41 is depicted in FIGS. 1-3 as being incorporated into tongue 34. The specific location of power source 41 may, however, vary depending upon the desired aesthetics, comfort, or other properties of footwear 10. As an example, power source 41 is depicted as being located in heel region 13 and on lateral side 14 in FIG. 8C. In other configurations, however, power source 41 may be located in any of regions 11-13 and also on medial side 15. When a separate battery and inverter are utilized for power source 41, the battery and inverter may also be located in different regions or sides of footwear 10. Moreover, power source 41 may also be embedded within sole structure 20 in some configurations of footwear 10.

Figure 9A:
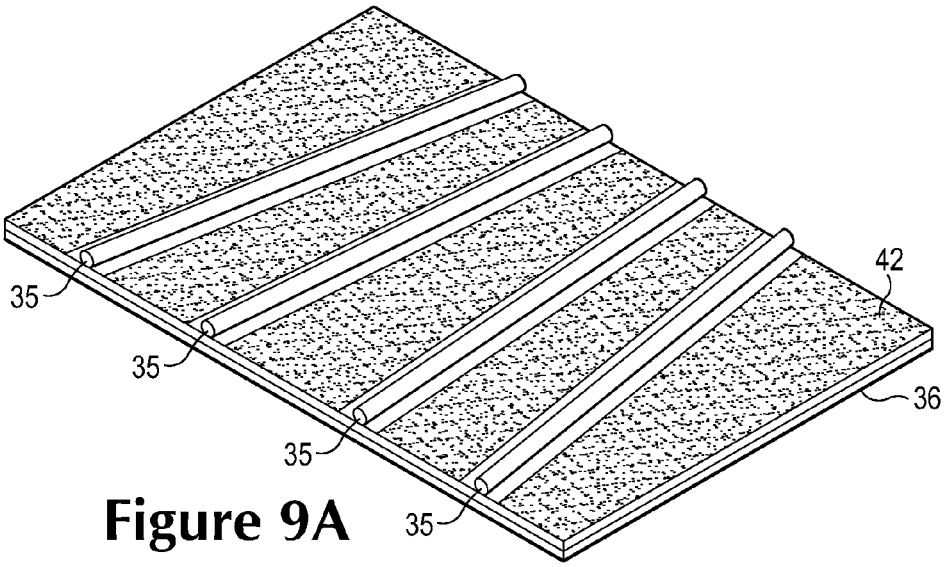
FIGS. 9A-9C are perspective views corresponding with FIG. 6 and depicting further configurations of the article of footwear.
Figure 9B:
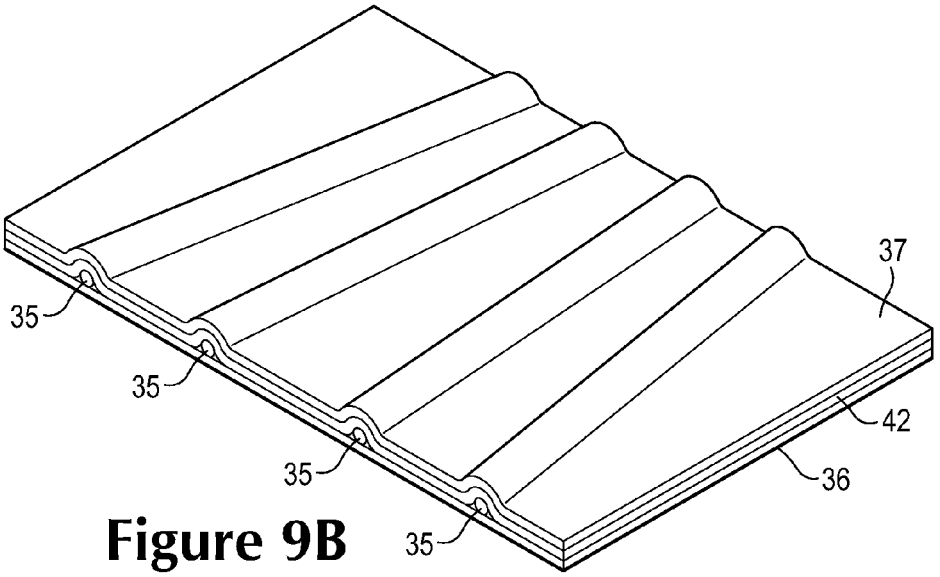
Figure 9C:
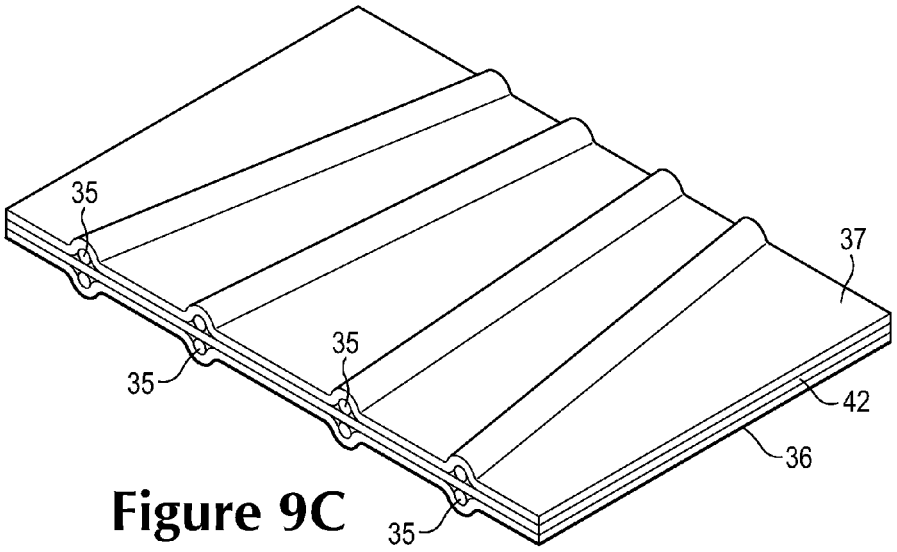

The layered configuration of upper 30 may also vary in further configurations of footwear 10. Referring to FIG. 9A, cover layer 37 may be absent such that strands 35 and illuminable elements 42 are exposed on the exterior of footwear 10. Strands 35 may also be positioned between illuminable elements 42 and interior layer 36, as depicted in FIG. 9B. Referring to FIG. 9C, strands 35 may further be located on both sides of illuminable elements 42, which may occur as a result of embroidery or other stitching process that locate strands 35 relative to illuminable elements 42.

Figure 10:
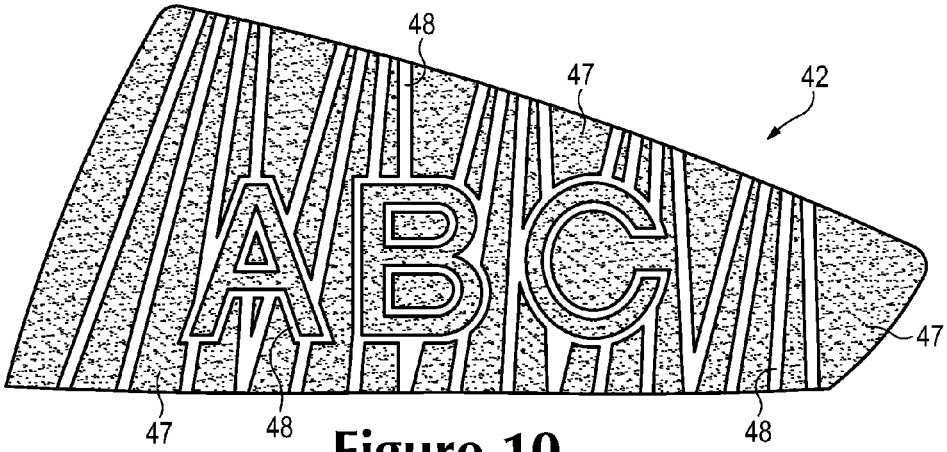
FIG. 10 is a schematic diagram depicting a further configuration of an illuminable element of the illumination circuit.

Although exposed areas 48 may be utilized to enhance, highlight, or otherwise increase the visibility of strands 35 or areas of upper 30 that include strands 35, exposed areas 48 may also be utilized for other purposes. For example, FIG. 10 depicts a configuration wherein exposed areas 48 define linear regions that correspond with strands 35, and exposed areas 48 also define the outline of indicia (i.e., the letters "ABC"). Exposed areas may, therefore, be utilized to impart information regarding the manufacturer (e.g., names, trademarks) or impart other information regarding footwear 10.

Figure 11:
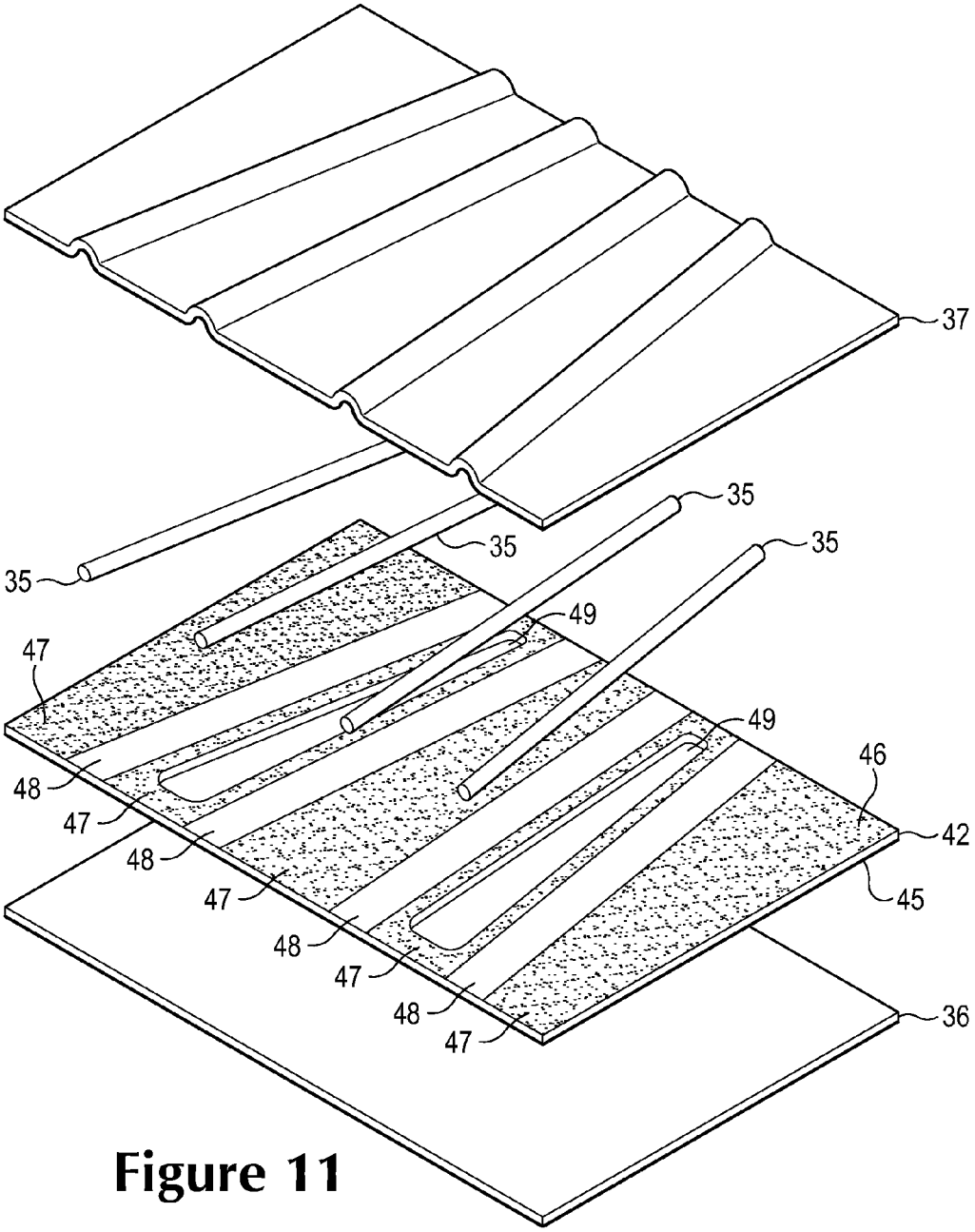
FIG. 11 is an exploded perspective view corresponding with FIG. 7 and depicting a further configuration of the article of footwear.

As discussed above, excess areas of illuminable elements 42 that are either beyond the periphery of covered areas 47 or within covered areas 47 may be cut away or otherwise removed (e.g., with a laser or other cutting apparatus), which may reduce the area of illuminable elements 42 that illuminate and save energy within illumination circuit 40. As an example of this concept, FIG. 11 depicts a configuration wherein one of illuminable elements 42 defines various apertures 49 between exposed areas 48. In further configurations, additional apertures or otherwise removed areas may be formed in illuminable elements 42.

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

The invention claimed is:

1. A method of making an article of footwear comprising:

securing a sole structure to an upper;

providing an illuminating panel that emits light, the illuminating panel including a first surface and an opposite second surface, wherein the illuminating panel is an electroluminescent panel;

removing one or more portions of the illuminating panel, thus forming one or more apertures extending through the illuminating panel;

partially covering the first surface of the illuminating panel with a substantially opaque covering, the substantially opaque covering blocking light emitted from the illuminating panel, wherein the partially covering step includes applying the substantially opaque covering to the first surface of the illuminating panel to form covered areas that include the substantially opaque covering and defines a plurality of exposed areas that are not covered by the substantially opaque covering between the covered areas;

applying a cover layer adjacent to the first surface of the illuminating panel, the cover layer forming at least a portion of an exterior surface of the upper, and the cover layer being formed from an at least semi-transparent material;

locating at least a portion of the illuminating panel between a lace region and a lower region of the upper; and positioning a plurality of strands adjacent to the illuminating panel and in the plurality of exposed areas of the illuminating panel.

2. The method of claim 1, wherein the plurality of exposed areas are a plurality of substantially linear exposed areas that extend from the lace region to the lower region of the upper.

3. The method of claim 2, wherein positioning the plurality of strands includes extending the plurality of strands in the plurality of substantially linear exposed areas of the illuminating panel from the lace region to the lower region.

4. The method of claim 1, wherein removing one or more portions of the illuminating panel is performed using a laser.

5. A method of making an article of footwear comprising:

securing a sole structure to an upper;

providing an illuminating panel that emits light, the illuminating panel having a first surface and an opposite second surface, the first surface being oriented to face toward an exterior of the article of footwear, and the second surface being oriented to face toward an interior of the article of footwear, wherein the illuminating panel is an electroluminescent panel;

covering a portion of the first surface with a substantially opaque covering to form a covered areas of the first surface of the illuminating panel and wherein the covered areas define exposed areas of the first surface of the illuminating panel, the covered areas being configured to block light emitted from the illuminating panel;

applying a cover layer adjacent to the first surface of the illuminating panel, the cover layer forming at least a portion of an exterior surface of the upper, and the cover layer being formed from an at least semi-transparent material;

positioning a plurality of strands to extend adjacent and parallel to the illuminating panel, wherein the plurality of strands are located in the exposed areas of the illuminating panel;

removing at least a portion of the illuminating panel from the covered areas and forming one or more apertures extending through the illuminating panel, thereby reducing the covered areas of the illuminating panel to be illuminated; and incorporating the illuminating panel into the upper such that the exposed areas of the illuminating panel is at least partially visible from the exterior of the article of footwear.

6. The method of claim 5, wherein removing at least a portion of the illuminating panel includes locating the one or more apertures separate from the exposed areas.

7. The method of claim 5, wherein the exposed areas includes a plurality of elongate linear portions.

8. The method of claim 7, wherein the plurality of elongate linear portions extend from a lace region of the upper to a region where the sole structure is secured to the upper.

9. The method of claim 8, wherein at least one of the one or more apertures is elongate and extends along one or more of the plurality of elongate linear portions of the exposed areas.

10. The method of claim 5, wherein incorporating the illuminating panel into the upper includes disposing the plurality of strands on a same side of the first surface as the substantially opaque covering.

11. The method of claim 5, wherein the plurality of strands resist stretch of the upper.

12. A method of making an article of footwear comprising:

securing a sole structure to an upper;

providing an illuminating panel that emits light, the illuminating panel having a surface, wherein the illuminating panel is an electroluminescent panel;

covering a portion of the surface of the illuminating panel with a substantially opaque covering to form a covered areas of the surface and wherein the covered areas define exposed areas of the surface, the covered areas being configured to block light emitted from the illuminating panel;

applying a cover layer adjacent to the surface of the illuminating panel, the cover layer forming at least a portion of an exterior surface of the upper, and the cover layer being formed from an at least semi-transparent material;

positioning a plurality of strands to extend adjacent and parallel to the illuminating panel, wherein the plurality of strands are located in the exposed areas of the illuminating panel;

removing at least a portion of the illuminating panel from the covered areas and forming one or more apertures extending through the illuminating panel, thereby reducing the covered areas of the illuminating panel to be illuminated; and incorporating the illuminating panel into the upper such that the exposed areas of the illuminating panel is at least partially visible from an exterior of the article of footwear.

13. The method of claim 12, wherein removing at least a portion of the illuminating panel includes locating the one or more apertures separate from the exposed areas.

14. The method of claim 12, wherein the exposed areas includes a plurality of elongate linear portions.

15. The method of claim 14, wherein the plurality of elongate linear portions extend from a lace region of the upper to a region where the sole structure is secured to the upper.

16. The method of claim 15, wherein at least one of the one or more apertures is elongate and extends along one or more of the plurality of elongate linear portions of the exposed areas.

* * * * *